United States Patent [19]

Branigan

[11] 3,958,368

[45] May 25, 1976

[54] FLUID PRESSURE POWERED ACTUATOR

[75] Inventor: Patrick Mannix Branigan, Dublin, Ireland

[73] Assignee: Institute For Industrial Research and Standards, Dublin, Ireland

[22] Filed: Sept. 25, 1974

[21] Appl. No.: 508,952

[30] Foreign Application Priority Data

Oct. 4, 1973 Ireland ..... 1774/73

[52] U.S. Cl. ..... 49/324; 40/386; 49/340

[51] Int. Cl.[2] ..... 92 34; E05F 15/04

[58] Field of Search ..... 49/324, 339, 340; 92/91, 92, 34, 37; 254/93 R, 93 HP

[56] References Cited

UNITED STATES PATENTS

| | | | |
|---|---|---|---|
| 3,047,257 | 7/1962 | Chester | 92/92 X |
| 3,202,061 | 8/1965 | Johnston | 92/37 |
| 3,375,619 | 4/1968 | Hurkamp | 92/92 UX |

*Primary Examiner*—Kenneth Downey
*Attorney, Agent, or Firm*—Ladas, Parry, Von Gehr, Goldsmith & Deschamps

[57] ABSTRACT

The present invention relates to a fluid pressure powered actuator for imparting relative angular movement between two members, connected together by a hinge, comprising an elongated inflatable flexible conduit of substantial constant surface area, connected between the two members with its longitudinal axis substantially parallel to the hinge pivot axis and with the two members substantially equispaced around the conduit whereby on inflation, the conduit exerts a pulling force between the two members to impart relative angular movement therebetween.

8 Claims, 11 Drawing Figures

FLUID PRESSURE POWERED ACTUATOR

BACKGROUND OF THE INVENTION

Introduction

The present invention relates to a fluid pressure powered actuator for imparting relative angular movement between two members connected together by a hinge.

Field of the Invention

The term "members connected together by a hinge" used in this specification includes not only a door or other closure member mounted in a frame or opening on a common form of hinge, that is to say a pair of rigid plates or the like pivotally connected by a hinge pin, but also includes any two hingedly connected members, that is to say any two members connected together by any jointing means, which allows relative angular motion about a pivot axis between the members similar to the relative angular motion that would be achieved if the members were connected by a more conventional construction of hinge.

It is known to provide a fluid pressure powered actuator for imparting relative angular movement between two members connected by a hinge in which the two members are arranged in a fixed angular relation to each other to form a substantially "V" shaped trough. At least one flexible sack or pouch of wedge shaped cross-section is disposed between the members and inflation of the pouch causes the members to be forced apart. For example U.S. Pat. No. 3,495,502 (D. E. Bousso) describes a device for converting fluid pressure to angular mechanical movement or vice versa, the device comprising at least one pouch of flexible material arranged to contain fluid under pressure and connected to hinge means arranged to restrain radial movement of the pouch relative to the axis of the hinge means.

U.S. Pat. No. 3,202,061 (L. B. Johnston) describes and claims a fluid actuator displacement and positioning system comprising; a pair of substantially rigid elongated members in juxtaposition; guide means to direct relative movement of the members; a closed chamber comprising a plurality of cells having flexible walls extending between and attached to one of the said members, and free of the other member, said flexible wall being so related to said members as to exert to force thereon when said chamber is subjected to fluid pressure; and the necessary means to introduce a fluid under pressure into the chamber.

These type of fluid pressure powered actuators may be described as "push" type fluid pressure powered actuators. There are, however, certain disadvantages in these known constructions of push type fluid pressure powered actuators in that they are relatively expensive to produce. Further they require a considerable amount of head room to install and indeed, are rather difficult to install in a confined space. Very often they require mechanical linkages to transmit the torque imparted or to magnify the displacement of the members. Further the flexible sack or pouch is often of rather large cross-sectional area. Additionally, these push type fluid pressure powered actuators impart substantially constant torque throughout their entire stroke and very often require a slave cylinder or buffer at the end of the stroke to provide adequate cushioning. Further with these push type fluid pressure powered actuators it has been noted that a considerable pressure is placed on the hinge between the two members, which thus necessitates the provision of fairly substantial and robust hinges.

OBJECTS

The present invention is directed towards providing an improved construction of fluid pressure powered actuator for imparting relative angular movement between two members connected together by a hinge.

Another object of the invention is to provide a fluid pressure powered actuator which will have a high initial starting torque and a low finishing torque thus giving a natural cushioning effect.

A further object of the invention is to provide a fluid pressure powered actuator that can be manufactured from relatively easily obtainable materials thus making it comparatively inexpensive to produce.

SUMMARY OF THE INVENTION

This invention provides a fluid pressure powered actuator for imparting angular movement comprising:

- a first member;
- a second member;
- a hinge connected between the two members and defining a hinge pivot axis for the members;
- an elongated inflatable conduit of substantially constant surface area, having its longitudinal axis substantially parallel to the hinge pivot axis;
- a first connecting means, connecting the conduit to the first member;
- a second connecting means, connecting the conduit to the second member; the second connecting means being spaced apart from the first connecting means around the conduit so that the first and second connecting means are substantially equispaced around the conduit; and
- means for inflating the conduit to exert a pulling force between the members to impart relative angular movement therebetween.

In one embodiment of the invention the connecting means comprises:

- a bar for location within the conduit;
- a base plate for mounting on the member;
- A hook-like member connected to the base plate and adapted for embracing from the exterior the bar and portion of the conduit, the edge of the hook-like member being spaced apart from the base plate to allow the conduit project therethrough;
- means for rigidly mounting the base plate of the first connecting means on the first member; and
- means for pivotally mounting the base plate of the second connecting means on the second member.

A further embodiment of the invention provides a fluid pressure powered actuator for opening and closing a door mounted by a hinge on a door frame comprising:

- an elongated and inflatable conduit of substantially constant surface area, having its longitudinal axis substantially parallel to the hinge pivot axis;
- a connecting means connecting the conduit to the door frame;
- a further connecting means connecting the conduit to the door, the two connecting means being arranged around the conduit so as to be substantially equispaced around the conduit;
- means for inflating the conduit to exert a pulling force between the members to impart relative angular movement therebetween; and means for returning the door to its original position on release of the fluid pressure.

The main advantages of the present invention are that readily obtainable materials are used thus reducing manufacturing costs. A further advantage of the invention is that the torque displacement characteristics of the fluid pressure powered actuator according to the invention are particularly suitable for closure members there being a high initial torque and a low finishing torque.

It has also been found that the present invention lends itself readily to installation on existing doors and that in view of the small cross-sectional area of the conduit that may be used it can be installed in very confined spaces along the length of the door post. A still further advantage of the fluid pressure powered actuator according to the present invention is that it has a very high torque to cross-sectional area ratio.

The above and other objects and advantages of this invention will become apparent from the following detailed description in connection with the accompanying drawings.

DETAILED DESCRIPTION OF THE INVENTION

Figure 1:
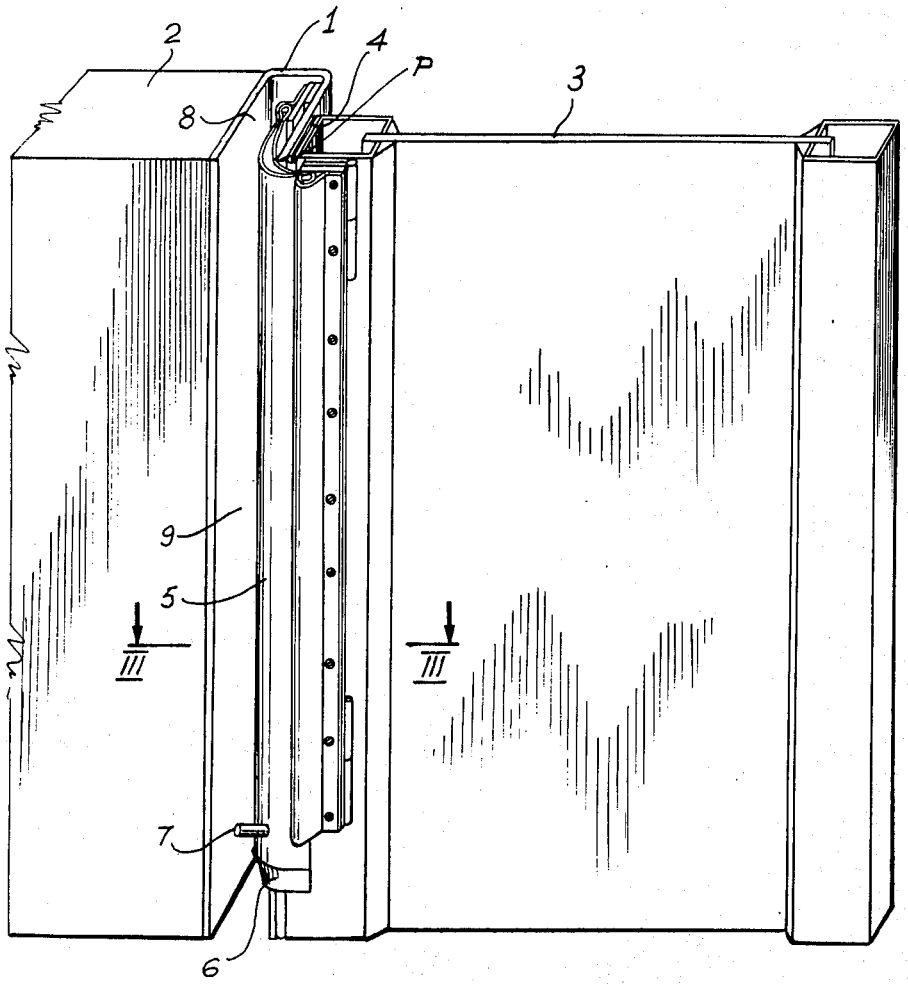
FIG. 1 is a cut-away perspective view of portion of a door, door frame and fluid pressure powered actuator according to the invention, some sectional lines being omitted for clarity.
Figure 2:
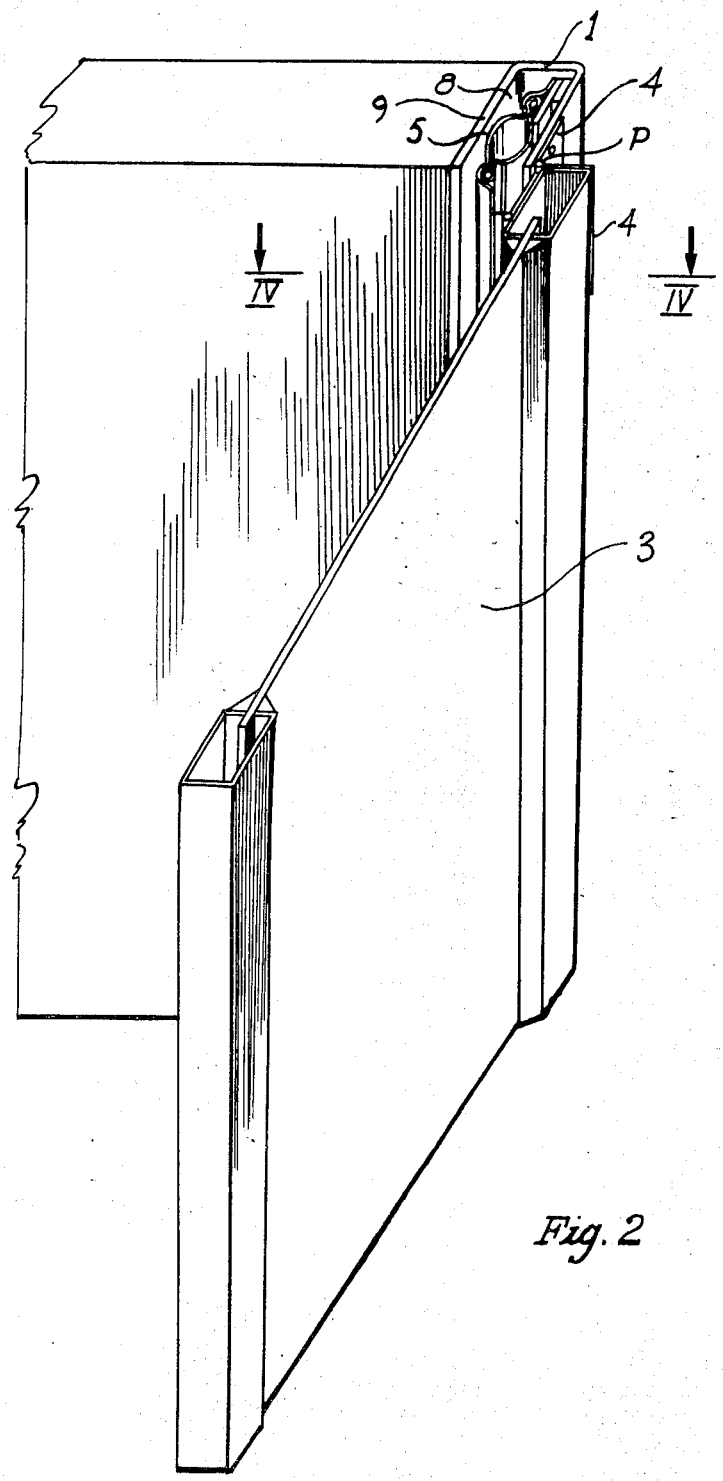
FIG. 2 is a view similar to FIG. 1 with the door in the open position.
Figure 3:
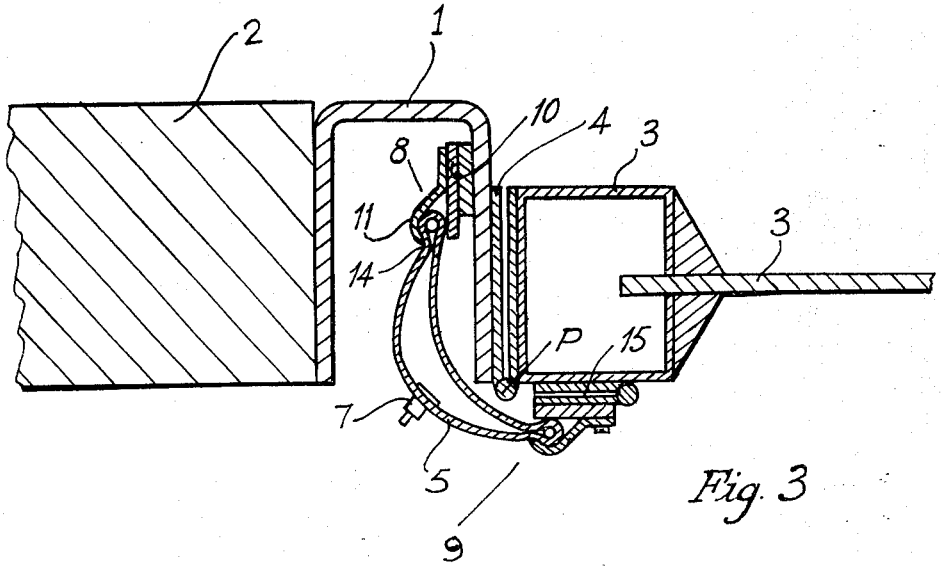
FIG. 3 is a cross-sectional view in the directions of the arrows III — III of FIG. 1.
Figure 4:
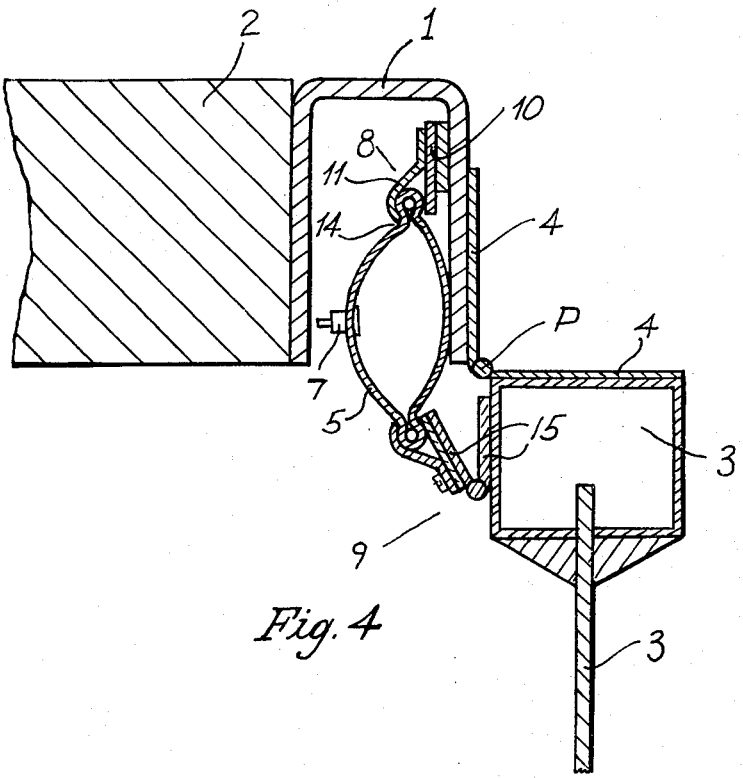
FIG. 4 is a cross-sectional view in the direction of the arrows IV — IV of FIG. 2.

Referring to the drawings and initially to FIGS. 1 to 4 thereof there is illustrated a first member namely a door post 1 forming part of a door frame of substantially channel section mounted within an opening in wall 2. A second member in this embodiment, a door, indicated generally by the reference numeral 3 namely an aluminium glazed door is mounted on the door post 1 by means of a hinge 4 having a hinge pivot axis P. A conduit 5 is mounted partially within the door post 1. The conduit 5 is sealed at both ends 6, only one end 6 is illustrated in FIG. 1. The conduit 5 is an inflatable flexible conduit of substantially constant surface area that is to say, on inflation the surface area does not expand appreciably. The conduit 5 is reinforced circumferentially and longitudinally. If the conduit 5 is not reinforced the conduit 5 on inflation will expand circumferentially to a balloon shape and it will creep and deflect in its longitudinal direction. Thus the energy supplied will be absorbed in the deformation of the conduit 5 and accordingly, the conduit 5 would be unsuitable for use in the fluid pressure powered actuator.

A pipe 7 connects the conduit 5 to an air supply and also serves as an air exhaust. The conduit 5 is mounted by a first connecting means, indicated generally by the reference numeral 8 and a second connecting means 9 on the door post 1 and the door 3 respectively. The first connecting means 8 comprises a base plate 10 for mounting on the door post 1 and a hook-like member 11 connected by bolts 12 to the base plate 1. A bar 13 is located within the conduit 5. The hook-like member 11 embraces from the exterior the bar 13 and portion of the conduit 5, it will be noted that the edge 14 of the hook-like member 11 is spaced apart from the base plate 10 sufficiently to accomodate two thicknesses of the conduit 5 and thus allow the conduit 5 project therethrough. The spacing is so arranged that the portion of the conduit 5 in contact with the bar 13 cannot pull out of or away from the connecting means 8.

The second connecting means 9 is substantially similar to the first connecting means 8 and similar parts are identified by the same reference numerals. The second connecting means 9 is however, mounted on the door post 1 by means of a hinge 15.

It will be noted that the first and second connecting means 8 and 9 are displaced relatively around the conduit and are substantially equispaced circumferentially around the conduit 5. On inflation of the conduit 5, as will be described below, the two connecting means 8 and 9 are substantially diametrically opposed relative to the conduit 5.

In operation, air under pressure is introduced from an air pressure source through the pipe 7 into the conduit 5 to inflate it. This causes the conduit 5 to assume a more cylindrical shape and thus reduce the distance between the two connecting means 8 and 9. This causes the door 3 to be pivoted on its hinges 4 about its hinge pivot axis P. It will be noted that, on inflation, the longitudinal axis of the conduit 5 is substantially parallel to the hinge pivot axis P. Needless to say when deflated the longitudinal axis of the conduit 5 in so far as it can be said to have one, is still substantially parallel to the hinge pivot axis P. A conventional door closing device, for example, spring or hydraulically operated, is provided (not shown). On deflation of the conduit 5 the door closing device operates to close the door.

Figure 5:
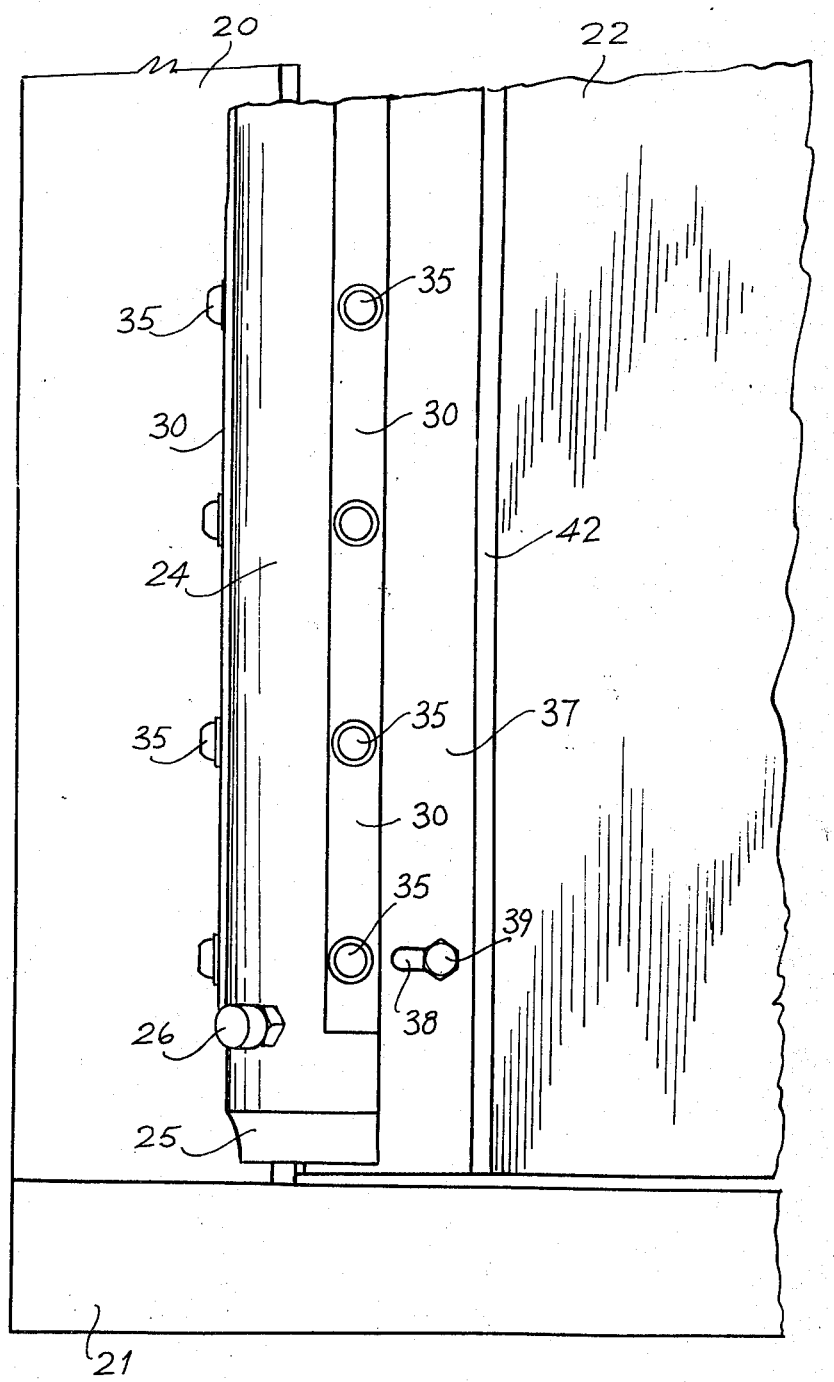
FIG. 5 is a front view of portion of a door, a door frame and alternative construction of fluid pressure powered actuator according to the invention.
Figure 6:
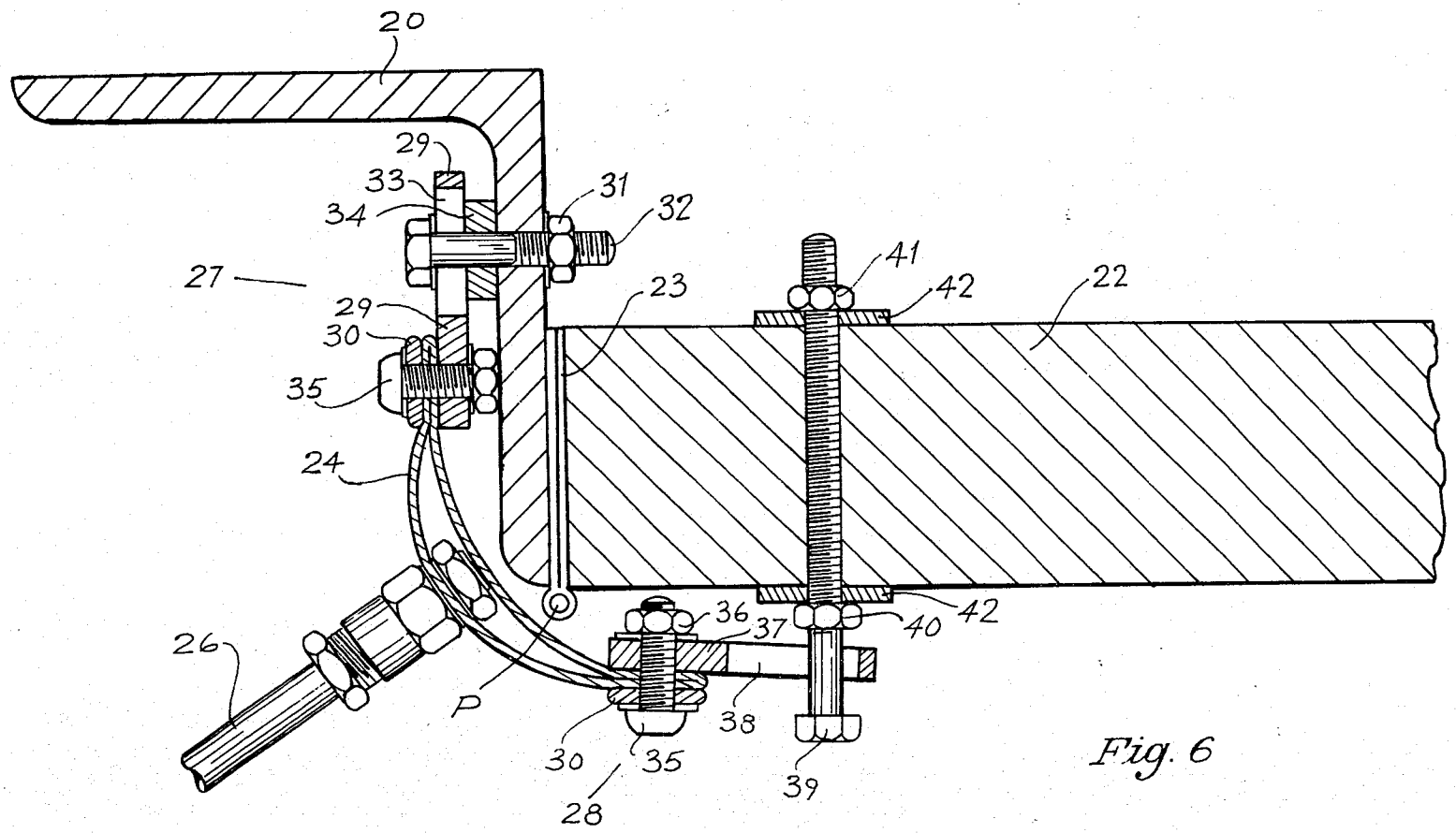
FIG. 6 is a cross-sectional view similar to FIG. 3 of the embodiment of FIG. 5.
Figure 7:
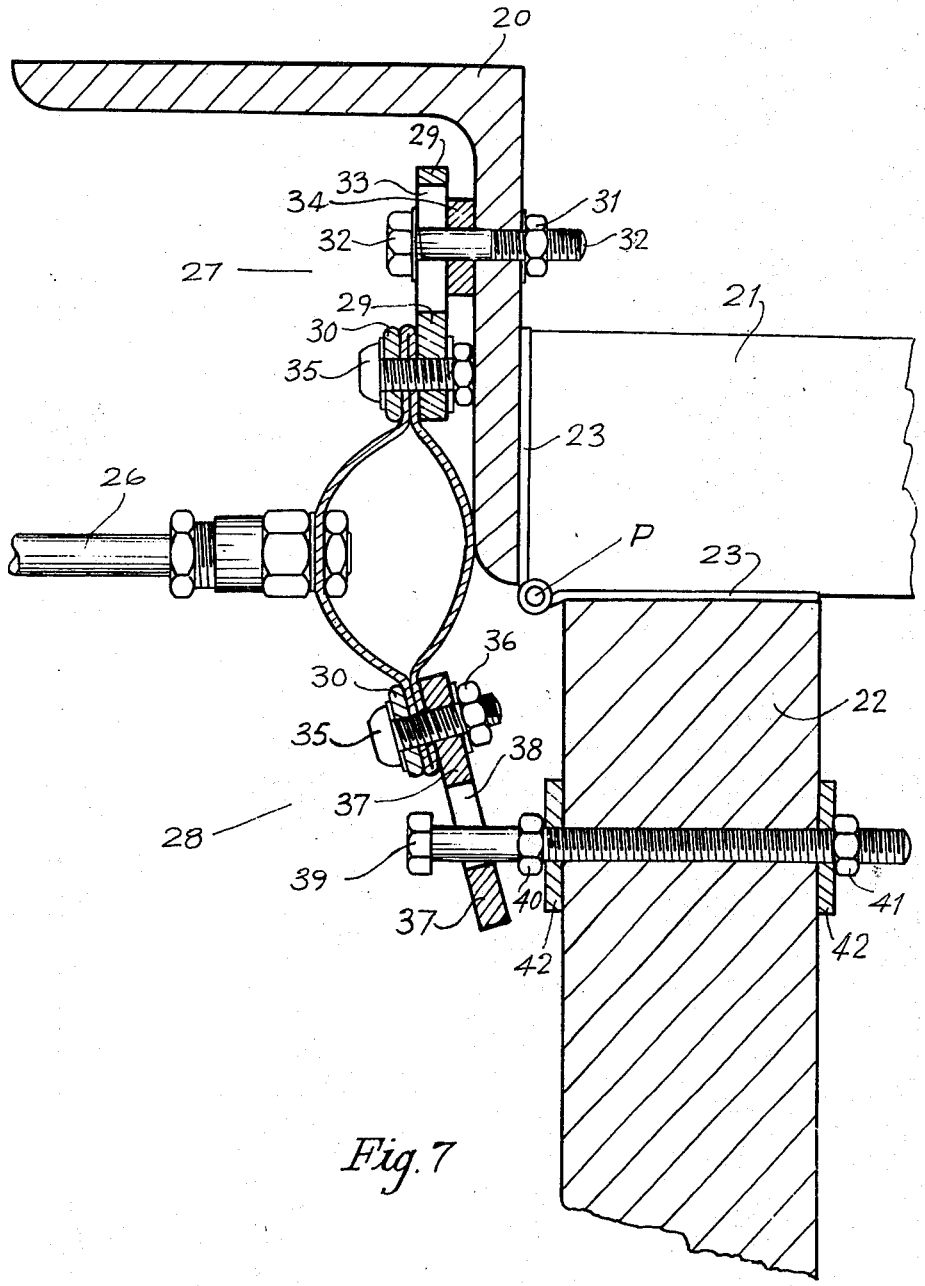
FIG. 7 is a cross-sectional view similar to FIG. 4 of the embodiment of FIG. 5.

Referring to FIGS. 5 to 7 inclusive there is illustrated an alternative construction of fluid pressure powered actuator according to the invention. There is illustrated a first member namely a door post 20 mounted on a door saddle 21. A second member namely door 22 is mounted on the door post 20 by means of a hinge 23 having a pivot axis P. A conduit 24 sealed at both ends 25, only one end 25 of which is shown, lies adjacent the door post 20. A pipe 26 connects the conduit 24 to an air supply and also serves as an air exhaust. The conduit 24 is mounted on the door post 20 by a first connecting means indicated generally by the reference numeral 27 and on to the door 22 by a second connecting means indicated generally by the reference numeral 28.

The first connecting means 27 comprises of a base plate 29 and a clamping plate 30.

The base plate 29 is secured to the door post 20 by means of a number of nuts 31 and bolts 32 each bolt 32 engages an elongated slot 33 in the base plate 29. A spacer plate 34 is mounted on the bolts 32 between the base plate 29 and the door post 20. The slot 33 is used for adjustment of the fluid pressure powered actuator on installation. The clamping plate 30 is secured to the conduit 24 by bolts 35 having nuts 36. Preferably, the conduit 24 is sealed on itself where it is pierced by the bolts 35 to ensure an air tight joint.

The second connecting means 28 comprises of a base plate 37 having an elongated slot 38 whose longitudinal axis is at right angles to the pivot axis P of the hinge 23. A further clamping plate 30 and nuts 36 and bolts 35 are used to secure the conduit 24 to the base plate 37. The base plate 37 is secured to the door 22 by means of bolts 39 and nuts 40 and 41. It will be noted that there is a space between the head of the bolt 39 and the nut 40. Stiffening strips 42 are secured to the door 22 by the nuts 40 and 41. Thus the base plate 37 has provision not only for limited linear movement along the door 22 relative to the pivot axis P of the hinge 23 but also for limited linear movement along the bolt 39 towards and away from the door 22.

The operation of the embodiment described with reference to FIGS. 5, 6 and 7 is substantially similar to the operation of the embodiment described in reference to FIGS. 1 to 4 inclusive.

Figure 8A:
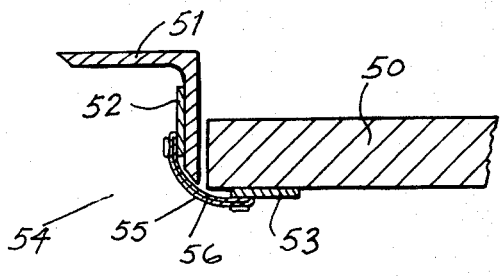
FIGS. 8(*a*), 8(*b*) and 8(*c*) are diagramatical cross-sectional views showing the operation of the fluid pressure powered actuator according to the invention.
Figure 8B:
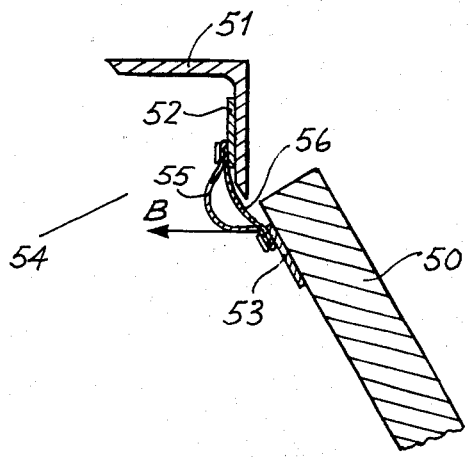
Figure 8:
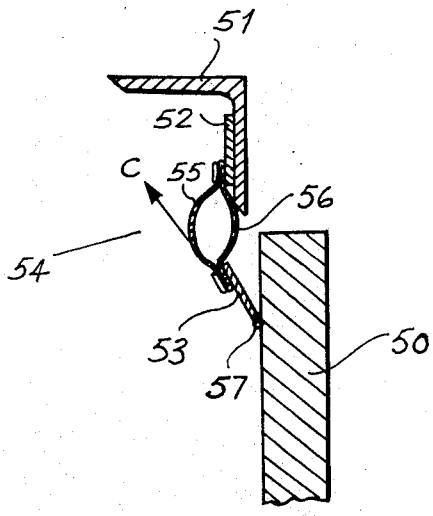

It will be noted that in both of the embodiments described above the conduit was not rigidly connected between the door post and the door. Referring to FIGS. 8(*a*) and 8(*b*) there is illustrated a first member 50 pivotally connected to a rigidly mounted second member 51 on which is mounted by first and second connecting means 53 and 52 a conduit indicated generally by the reference numeral 54, the outer portion of which is identified by the reference numeral 55 and the inner portion by the reference numeral 56. The "hinge" connection between the members 50 and 51 is not shown. The connecting means 52 and 53 are rigidly connected respectively to the members 51 and 50. When the conduit 54 is inflated the first member 50 pivots through approximately 60° away from the member 57. At this stage the first member 50 stops pivoting. It is believed that the reason why the first member 50 stops pivoting is firstly, that the inner portion 56 of the conduit exerts a pressure inwards on the members 50 and 51, and hence against further pivotal movement. It is also believed that the pull of the conduit 54 is mainly exerted through its outer portion 55 and that this is now not operating in the most efficient direction. It is believed that the pull exerted by the conduit 54 on inflation is exerted through its outer portion 55 and thus substantially tangentially at its connecting means 52 and 53, that is to say that the main pull on the first member 50 is in the direction of the arrow B (FIG. 8(*b*)).

Referring to FIG. 8(*c*) there is illustrated substantially the same fluid pressure powered actuator, the same parts being identified by the same number the only difference between the embodiment described in FIG. 8(*c*) and the embodiment described with reference to FIGS. 8(*a*) and 8(*b*) is that the first connecting means 53 is now hingedly mounted at 57 on the first member 50. Because the first connecting means 53 is hinged on the first member 50 the first member 50 opens through 90°. This it is believed is because the pull of the conduit 54 on the first member 50 is now operating in the direction of the arrow C which is tangential to the outer portion 55 and it is now operating so as to pull the first member 50 wider relative to the second member 51.

Displacements of up to 120° have been achieved by a fluid pressure powered actuator mounted between two hingedly connected members.

Figure 9:
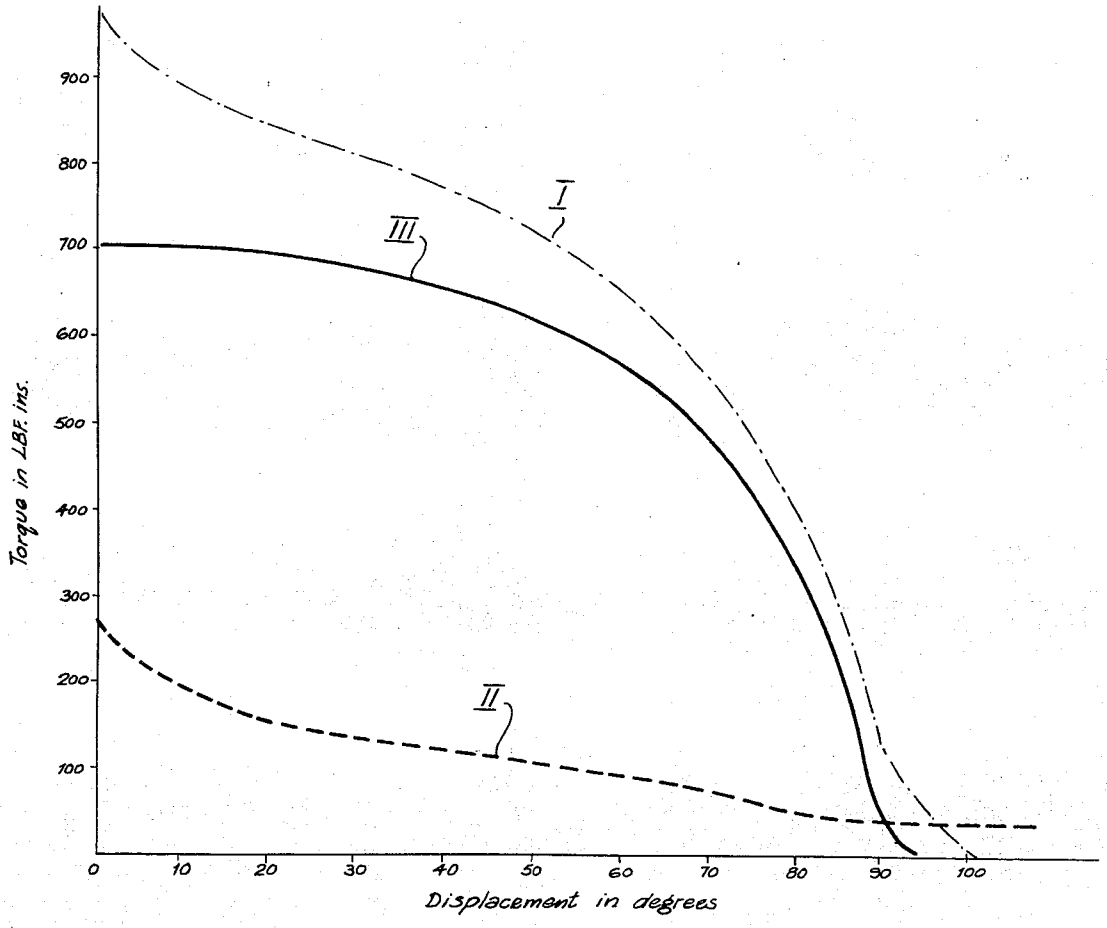
FIG. 9 is a typical torque displacement characteristic curve of a fluid pressure powered actuator according to the invention.

Referring to FIG. 9 there is illustrated the torque displacement characteristics of a fluid pressure powered actuator according to the present invention. This fluid pressure powered actuator comprises a 6 foot length of conduit of 2½ inch diameter which, when it was clamped in position had an effective diameter of 1½ inches. The conduit was operated from an air supply at 30 p.s.i. There are illustrated three torque displacement curves:

Graph I illustrated the actual torque exerted by the fluid pressure powered actuator on the door, and
Graph II illustrates the torque of a conventional door closer mounted on the door, thus operating against the fluid pressure powered actuator and
Graph III represents the resultant torque of the fluid pressure powered actuator on the door.

It will be noted that the torque exerted by the fluid pressure powered actuator is initially rather high and that as the door opens the torque is reduced thus giving a natural cushioning effect.

While the embodiments described above relate to a door mounted on a door post it will be appreciated that the invention is equally applicable to any two members connected together by a hinge.

It will also be appreciated that fluids other than air for example, water may be used to operate the fluid pressure powered actuator. In view of the large diameter of conduit used there is no necessity to provide a clean fluid. It has been found that one of the advantages of the present invention is that it lends itself readily to installation on existing doors. A small cross-sectional area of conduit may be used and therefore, it can be installed in a very confined space along the length of the door post. It has also been found that the fluid pressure powered actuator has a very high torque to cross-sectional area ratio. Further it has been noted that the torque characteristics of this "pull" type fluid pressure powered actuator is more suitable for hinged door and closure member applications than push type fluid pressure powered actuators in that there is a high initial torque to overcome the initial high forces and a low finishing torque giving adequate cushioning at the end of a stroke. It has also been found with a fluid pressure powered actuator according to the invention, that longer life of the conduit due to limited flexing has been achieved, than with push types. The installation and manufacturing costs of the fluid pressure powered actuator according to the present invention are relatively low as it will be appreciated that relatively cheap "off the shelf" conduit may be used. In fact the invention has operated satisfactorily using conventional fire hose.

I claim:

1. In combination, a first member, a second member, a hinge connecting the first member to the second member and defining a hinge pivot axis for the members, and a fluid pressure powered actuator for imparting angular movement to the first member relative to the second member in one sense about said axis, the actuator comprising:

an elongated inflatable conduit of substantially constant surface area, the conduit having its longitudinal axis substantially parallel to the hinge pivot axis and being disposed in that angle between the two members which is reduced on the first member moving relative to the to the second member about said axis in said one sense;

a first connecting means, connecting the conduit to the first member;

a second connecting means, connecting the conduit to the second member, the second connecting means being spaced apart from the first connecting means around the conduit so that the first and second connecting means are substantially equispaced around the conduit; and means for inflating the conduit to exert a pulling force between the members to impart angular movement to said first member relative to said second member in said one sense about said axis.

2. A combination as recited in claim 1 in which one of the connecting means is pivotally connected to the appropriate member about an axis substantially parallel to the hinge pivot axis.

3. A combination as recited in claim 1 in which the first connecting means includes a plate having an elongated slot at right angles to the hinge pivot axis and means for engaging the slot so that the plate has limited linear movement perpendicular to and parallel to the first member.

4. A combination as recited in claim 1 in which each connecting means comprises:

a bar for location within the conduit;

a base plate for mounting on the member;

a hook-like member connected to the base plate and adapted for embracing from the exterior the bar and portion of the conduit, the edge of the hook-like member being spaced apart from the base plate to allow the conduit project therethrough;

means for rigidly mounting the base plate of the first connecting means on the first member: and means for pivotally mounting the base plate of the second connecting means on the second member.

5. A combination as claimed in claim 4 in which the actuator is powered pneumatically.

6. A combination as recited in claim 1 in which the actuator is powered pneumatically.

7. A fluid pressure powered actuator for opening or closing a door mounted by a hinge on a door frame comprising:

an elongated and inflatable conduit of substantially constant surface area, having its longitudinal axis substantially parallel to the hinge pivot axis and being disposed in that angle between the door and the door frame which is reduced on operation of the actuator;

a connecting means connecting the conduit to the door frame;

a further connecting means connecting the conduit to the door, the two connecting means being arranged around the conduit so as to be substantially equispaced around the conduit;

means for inflating the conduit to exert a pulling force between the door and the door frame to impart angular movement to the door relative to the frame to reduce said angle; and means for returning the door to its original position on release of the fluid pressure.

8. A fluid pressure powered actuator as recited in claim 7 in which the means for returning the door to its original position is conventional spring means.

* * * * *